US006437521B1

(12) United States Patent
Pienisaari

(10) Patent No.: US 6,437,521 B1
(45) Date of Patent: Aug. 20, 2002

(54) ELECTRONIC CONTROL CIRCUIT

(75) Inventor: Heikki Pienisaari, Mäntsälä(FI)

(73) Assignee: Innoware Oy (FI)

( * ) Notice: Subject to any disclaimer, the term of this patent is extended or adjusted under 35 U.S.C. 154(b) by 0 days.

(21) Appl. No.: 09/719,293

(22) PCT Filed: Jun. 10, 1999

(86) PCT No.: PCT/FI99/00509

§ 371 (c)(1),
(2), (4) Date: Dec. 7, 2000

(87) PCT Pub. No.: WO99/65280

PCT Pub. Date: Dec. 16, 1999

(51) Int. Cl.[7] ..... H05B 37/02
(52) U.S. Cl. ..... 315/291; 315/244; 315/276
(58) Field of Search ..... 315/276, 244, 315/219, 209 R, 291, 277, 278, 263

(56) References Cited

U.S. PATENT DOCUMENTS

| | | | | |
|---|---|---|---|---|
| 4,982,314 A | | 1/1991 | Miki | 363/16 |
| 5,021,716 A | * | 6/1991 | Lesea | 315/219 |
| 5,144,203 A | | 9/1992 | Fujita et al. | 315/226 |
| 5,317,497 A | | 5/1994 | Belek | 315/169.3 |
| 5,399,944 A | * | 3/1995 | Konopka et al. | 315/219 |
| 5,461,286 A | * | 10/1995 | Hirschmann | 315/209 R |
| 5,517,089 A | | 5/1996 | Ravid | 315/219 |
| 5,583,398 A | | 12/1996 | Dellamano et al. | 315/247 |

FOREIGN PATENT DOCUMENTS

| | | |
|---|---|---|
| JP | 7245186 | 9/1995 |

* cited by examiner

*Primary Examiner*—Don Wong
*Assistant Examiner*—Wilson Lee
(74) *Attorney, Agent, or Firm*—Leydig, Voit & Mayer, Ltd.

(57) ABSTRACT

An electronic control circuit for adjusting the control voltage of a device to be controlled, the control circuit comprising a primary coil, a control bus comprising means for adjusting the control voltage, parallel-connected with the first capacitor, the paralleling being further series-connected with the first secondary coil and a first control diode, and a control voltage supply circuit comprising a series-connected second secondary coil, a second control diode and a second capacitor. The primary coil is connected between a first node and a second node of the device to be controlled, and the nodes in the connection are selected such that the current in an electric circuit between them at least momentarily reaches the value zero.

16 Claims, 3 Drawing Sheets

ELECTRONIC CONTROL CIRCUIT

FIELD OF THE INVENTION

The invention relates to an electronic control circuit for adjusting the control voltage of a device to be controlled, the control circuit comprising a primary coil, a control bus comprising a first secondary coil, a first control diode, a first capacitor and means for adjusting the control voltage, the means being parallel-connected with the first capacitor, the parallel connection being further series-connected with the first secondary coil and the first control diode, and a control voltage supply circuit comprising a series-connected second secondary coil, a second control diode and a second capacitor.

In the present specification, the term diode refers to any electronic component conducting current in one direction only and providing a diode-like effect. It is obvious to a person skilled in the art that this can be implemented by a transistor, for example. In the same way, in the present specification, the term capacitor refers to any capacitive element which is electrically chargeable in the same way as a capacitor.

BACKGROUND OF THE INVENTION

Electronic control loops and circuits commonly employ a separate control unit which often requires galvanic separation from the equipment to be controlled. Galvanic separation enables a sufficient electric separation between different electronic circuits and yet at the same time transmits a voltage signal from one electronic circuit to another. Galvanic separation is implemented by either optical or magnetic components.

The use of a 1 to 10 volt direct-current voltage as the control voltage has become more common in many electronic control circuits, particularly in lighting control systems. In this case a 10 V control voltage creates a maximum light level and a 1 V control voltage a minimum light level. Minimum and maximum light levels can preferably be freely selected and adjusting the control voltage allows the light level to be changed steplessly between minimum and maximum values. Usually the operating voltage of a control unit is directly supplied from the power source of the device to be controlled, the power source supplying current to the control unit via a control bus. This solution enables a simple implementation for a control unit, whereby the control unit does not necessarily require external operating voltage. Such a control principle is commonly used for example in adjusting electronic connectors in fluorescent lamps, phase angle controllers and electronic halogen and neon lamp transformers.

A control circuit is often implemented by the connection shown in FIG. 1. The connection comprises a control transformer T1 having three coils N1, N2 and N3. N1 is the primary coil of the transformer, N2 the secondary coil of a control bus 1 and N3 the secondary coil of a device to be controlled. The control bus 1 further comprises a diode D1, a adjustable zener diode Z1 and a capacitor C1. The diode D1 is series-connected with the secondary coil N2 of the control bus 1. The zener diode Z1 and the capacitor C1 are parallel-connected, the paralleling, in turn, being series-connected with the secondary coil N2 of the control bus 1 and the diode D1. In a control voltage supply circuit 2, the secondary coil N3 of the device to be controlled is series-connected with the diode D2 and the capacitor C2. A switch K1 is coupled to the primary coil N1 of the transformer, and opened and closed under the control of a control block A.

The operation of the control block A is known per se to a person skilled in the art, and does not need to be discussed in any greater detail herein.

The connection of the control circuit is what is known as a forced flyback connection. As the control block A closes the switch K1, a magnetization current starts to flow in the primary coil N1 of the transformer T1. The magnitude of the magnetization current varies substantially between 5 and 100 mA. The operating current of the control block A is typically between 3 and 5 mA. The coiling directions of the coils in the transformer T1 are so selected that the ends of the secondary coils N2 and N3 on the side of the diodes D1 and D2 are negative when the magnetization current is flowing, whereby no current flows in the secondary coils N2 and N3. The level of the control voltage is controlled by an adjustable zener diode Z1. When the control block A opens the switch K1, the magnetization energy stored in the ferrite of the transformer T1 causes a current in the secondary coils N2 and N3 charging the capacitors C1 and C2. The magnitude of the voltage $U_c$ over the capacitor C1 is adjusted by the zener diode Z1. In this case, provided the secondary coils N2 and N3 have an identical number of turns, the control voltage $U_e$ of the device to be controlled is equal to the voltage $U_c$, i.e. $U_e=U_c$. This way the voltage level, adjusted by the zener diode Z1, for controlling the light level, has been transmitted magnetically.

In accordance with prior art, the control circuit connection can be also implemented by a connection according to FIG. 2. The connection in FIG. 2 is what is known as a blocking oscillator, in which the control block A and the switch K1 have been replaced by a transistor V1, resistors R1, R2 and R3 and a capacitor C3 as compared with the connection in FIG. 1. Together with a coil N1, these form an oscillation circuit in such a way that the coil N1 is connected to the emitter of the transistor V1, the resistors R1 and R2, the coil N3 and the resistor R3 are parallel-connected with these to the operating voltage, and the capacitor C3 is parallel-connected with the resistors R1 and R2 and the coil N3. The filtering capacitor C2 is prevented from being charged by connecting it with a reverse-biased diode D2 between the transistor V1 and the coil N1. The base current of the transistor can be taken preferably from between the resistors R1 and R2, for example.

The base current of the transistor V1 flows via the resistor R2, the coil N3 and the resistor R3 and brings the transistor V1 to a saturation state, whereby the operation of the transistor V1 corresponds to a closed switch, and as a result the coil N1 is coupled via the transistor V1 to the operating voltage $V_{cc}$. The current passing through the coil N1 makes the coil N1 operate as a primary coil with respect to N3, whereby an increasing voltage in N3 controls more strongly the transistor V1 to a saturation state. When the current passing through the coil N1 increases so high that the base current is no longer sufficient to keep the transistor V1 in a saturation state, the direction of the current passing through the transistor V1 turns in an opposite direction. As the voltage over the coil N1 decreases, the base current also decreases, making the transistor V1 an opened switch. An opposite current direction opens the diode D2, whereby a negative control voltage $U_e$ charges over the capacitor C2 and has a magnitude which is determined by the relation between the number of turns of the coils N1 and N2, i.e. $U_e=(-N1/N2)*U_c$.

In other words, in prior art solutions, the magnetization current of the primary coil is taken from the operating voltage of the control electronics of the device to be controlled, the voltage being typically between 10 and 15 V.

In this case, if the control current is 1 mA, a typical value for the control current, the output level is correspondingly (10–15 V)*1 mA=10 to 15 mW. The efficiency of the connection in FIG. 1 is about 0.5 and that of the connection in FIG. 2 about 0.2. In this case the power consumption of the connections is 2 mA and 5 mA, respectively. in addition, in the connection according to FIG. 1, the control block A typically consumes between 3 and 5 mA of current.

However, prior art solutions show clear drawbacks. In both of the above connections the power source of the device to be controlled also operates as the power source of the control circuit, which further increases power consumption. In the connection of FIG. 1, the control block A needs an individual operating current. In both connections, the transformer T1 needs significantly much space as compared with the space required by the entire control circuit. The size of the transformer is influenced mainly by isolation class and the space taken up by the coils. Also, when a plurality of turns are required, the amount of coiling work naturally also increases. From the point of view of the operation, the use of a small toroidal or E core body is advantageous at a frequency of about 20 kHz, for example, and the required number of turns in the coils are in the order of 15/10/10 (N1/N2/N3) in the connection of FIG. 1 and 10/10/3 in the connection of FIG. 2, respectively.

SUMMARY OF THE INVENTION

It is the object of the present invention to provide a control circuit avoiding the above drawbacks. To be more exact, the control circuit of the invention is characterized by the primary coil being connected between a first node and a second node of the device to be controlled, and the nodes being selected such that the current in an electric circuit between them at least momentarily reaches the value zero. It is an essential idea of the invention to achieve primary coil magnetization current without separate control electronics, but to have a power supply in the device to be controlled generate the magnetization current. It is the idea of another preferred embodiment of the invention that one primary coil turn is sufficient because of the high value of the magnetization current.

It is an advantage of the invention that in the control circuit of the invention, the number of components is lower, resulting in a simpler connection. The primary coil has one turn of wiring only, and this is a further advantage of the invention, requiring less coiling work and enabling a substantially smaller transformer size. Furthermore, the solution of the invention brings about power savings, since the magnetization current is taken directly from the device to be controlled.

BRIEF DESCRIPTION OF THE DRAWINGS

In the following the invention will be described in greater detail with reference to the attached drawings, in which.

DETAILED DESCRIPTION OF THE INVENTION

Figure 1:
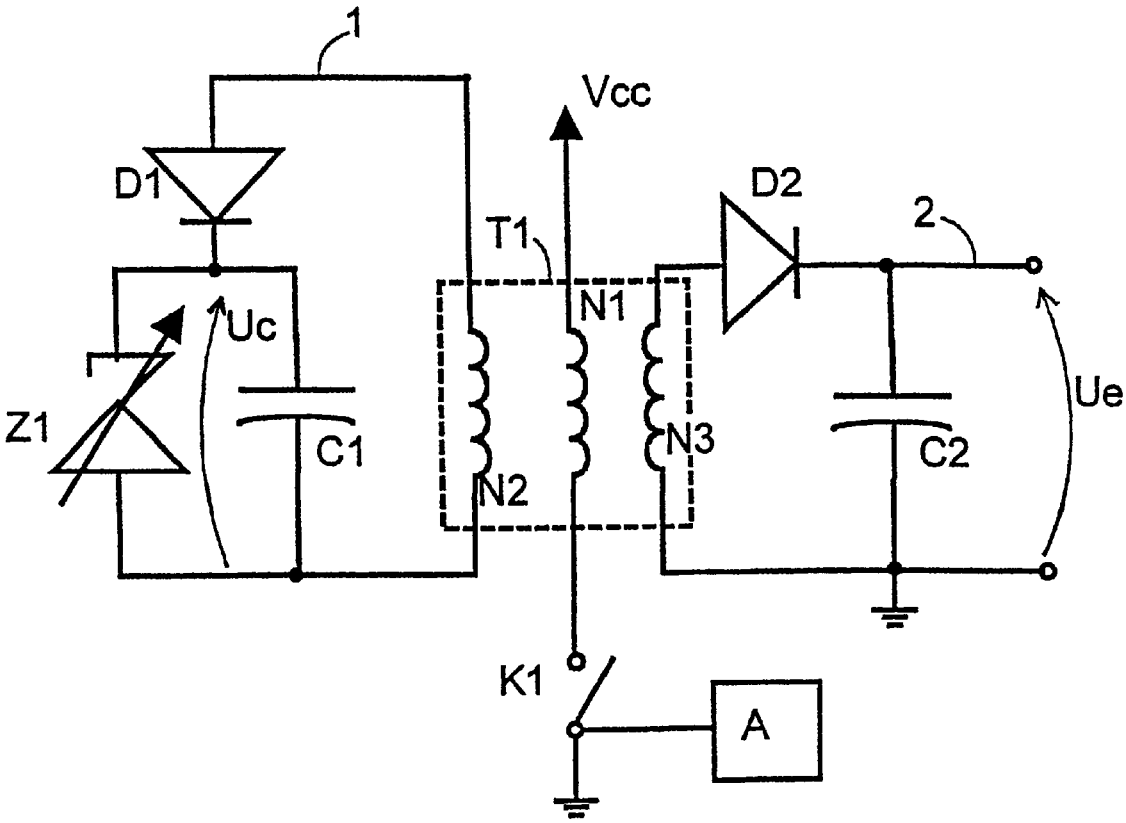
PRIOR ART FIG. 1
FIG. 1 shows a prior art control circuit as an exemplary wiring diagram.
Figure 2:
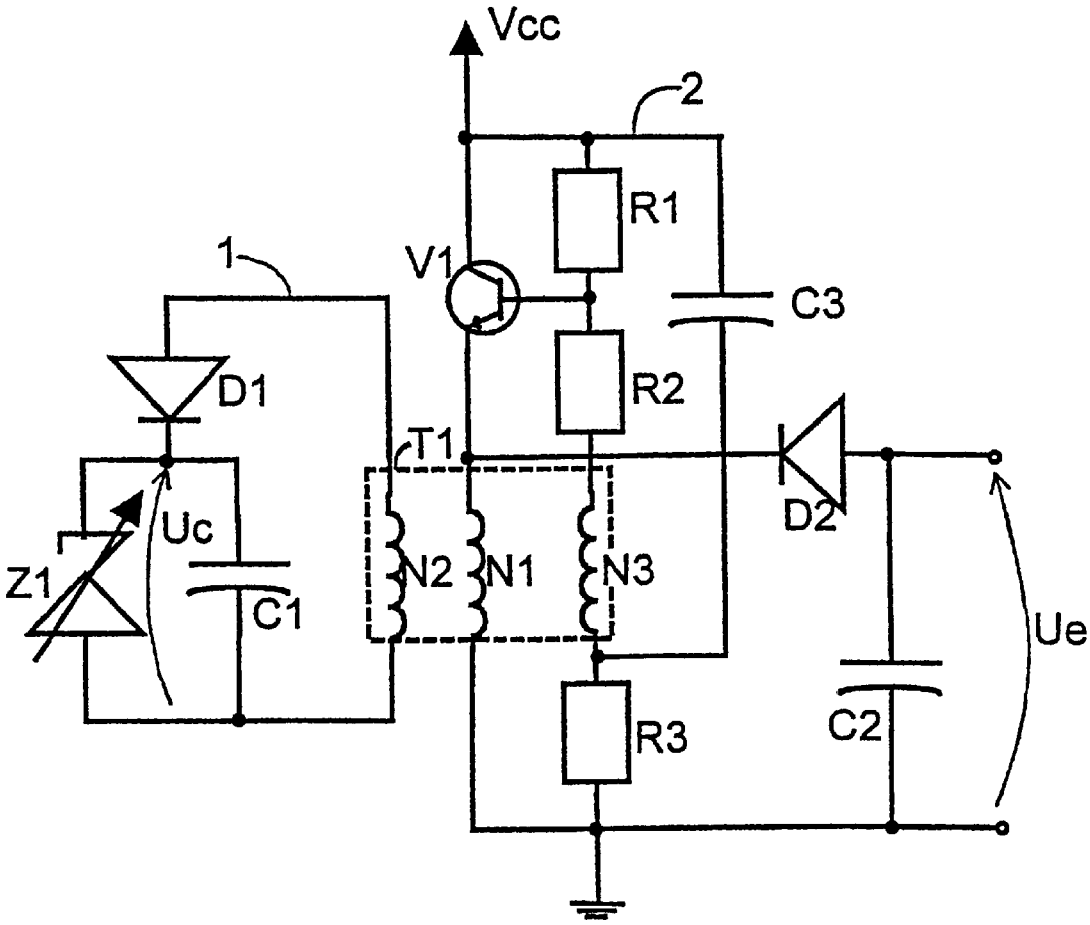
PRIOR ART FIG. 2
FIG. 2 shows another prior art control circuit as an exemplary wiring diagram.
Figure 3:
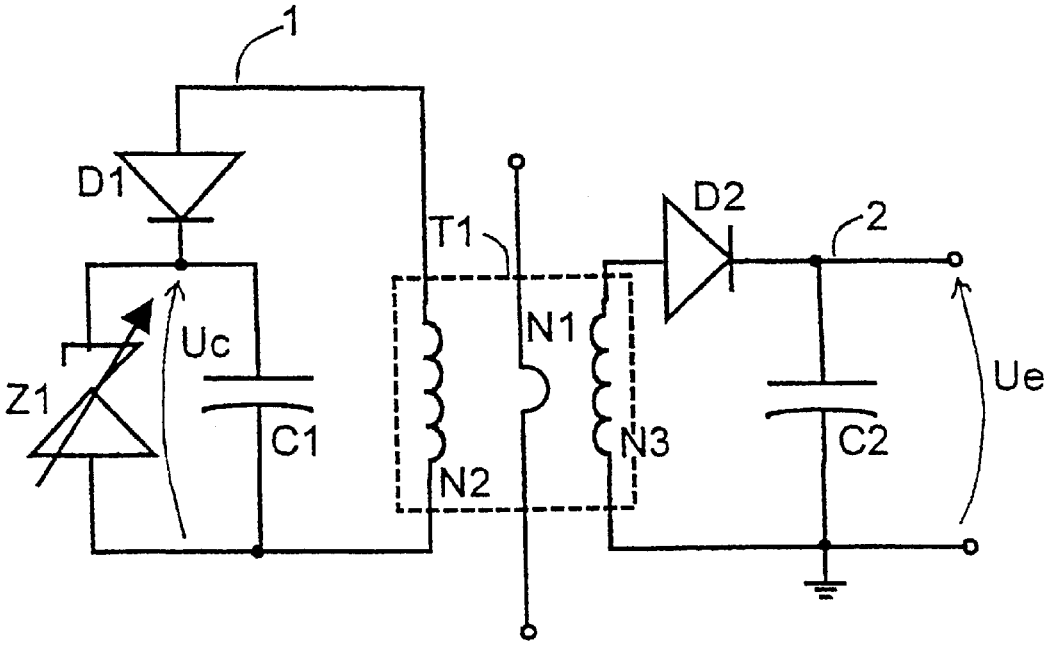
FIG. 3 shows a control circuit of the invention as an exemplary wiring diagram.

FIG. 3 is a wiring diagram of a control circuit of the invention. The connection comprises a control transformer T1 having three coils N1, N2 and N3. N1 is the primary coil of the transformer, N2 is the secondary coil of a control bus 1 and N3 is the secondary coil of a device to be controlled. The control bus 1 further comprises a diode D1, means for adjusting the control voltage, preferably an adjustable zener diode Z1 and a capacitor C1. The diode D1 is series-connected with the secondary coil N2 of the control bus 1. The zener diode Z1 and the capacitor C1 are parallel-connected, and the parallel connection, in turn, is series-connected with the secondary coil N2 of the control bus 1 and the diode D1. In a control voltage supply circuit 2 the secondary coil N3 of the device to be controlled is series-connected with the diode D2 and the capacitor C2. In the solution of the invention, the primary coil N1 of the transformer is connected between any two nodes of the device to be controlled, the current in the electric circuit between the nodes reaching the value zero at least momentarily. The magnetization current is led to the primary coil, which stores magnetization energy to the transformer T1. Magnetization energy is discharged for the secondary coils as the current reaches zero in the electric circuit to which the primary coil is connected. Electrical circuits in which the current momentarily reaches zero or is reversed are typically found in all power supplies.

The control circuit of the invention does not require a primary coil control block or any switch solution for controlling the magnetization current. This reduces the number of control circuit components, which simplifies the connection, reduces the space needed by the connection and improves the reliability of the control circuit. The top values of the currents of the power supply almost always exceed 0.1 A, whereby the magnetization current becomes so high that only one primary coil turn is needed. This decreases coiling work and also enables a significantly smaller transformer T1 size.

The solution of the invention also results in savings in power consumption. Some embodiments of the invention can produce as much as almost 5 mA current savings. This is especially significant if the operating voltage of the device to be controlled is produced resistively from mains voltage, whereby the power savings can be in the order of 230 V*5 mA≈1.2 W.

Figure 4:
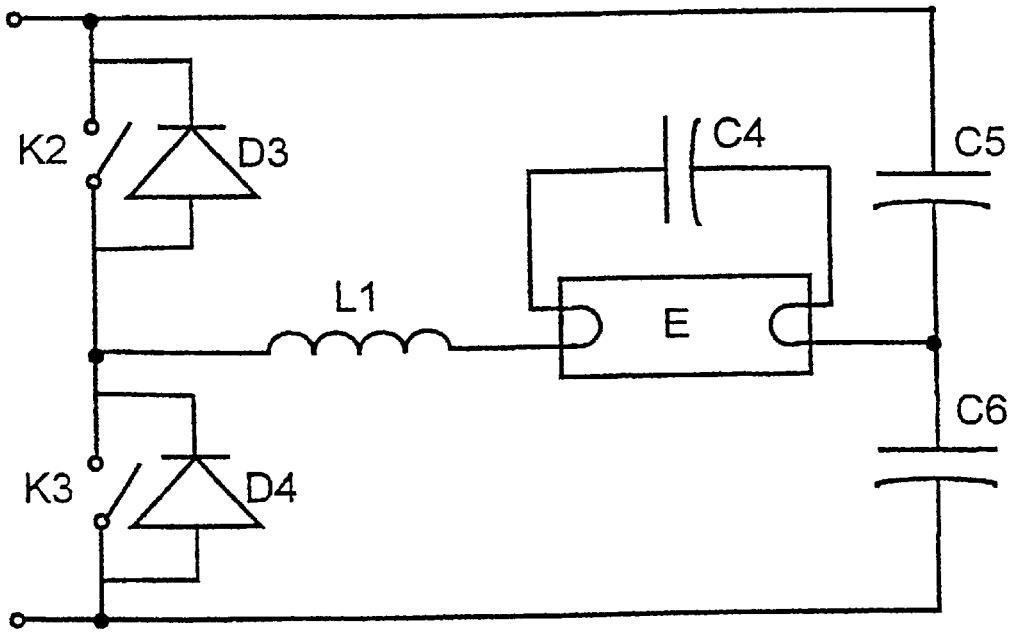
FIG. 4 shows an exemplary wiring diagram of a half bridge configuration that can be utilized in the invention.

FIG. 4 shows a wiring diagram of a half bridge configuration that can be utilized in the invention. The connection of FIG. 4 can be used as the ballast circuit of a fluorescent lamp, for example. In the connection the fluorescent lamp E and the capacitor C4 are parallel-connected, and the parallel connection further in series with the coil L1. When current is connected to the circuit it first operates as an LC circuit striving at resonance. This generates a high voltage over the capacitor C4, turns the fluorescent lamp E on and in practice the circuit starts to operate as an LR circuit. When the fluorescent lamp E tends to turn off, the LC circuit again starts to resonate and consequently prevents the lamp from turning off. Supply voltage switch functions K2 and K3 can be implemented by transistors, for example, whereby the diodes D3 and D4 are not necessarily needed, depending on the components. In this case the control circuit of the invention can be implemented by connecting the primary coil as part of any part of the electric circuit, preferably as part of the circuit controlled by either of the switches K2 or K3, for example. In this case the current preferably momentarily reaches zero as the switch opens.

It is obvious to a person skilled in the art that the invention can be implemented in a variety of ways. For example, instead of a zener diode, different control circuits can be used for adjusting the control voltage. Thus the invention and its embodiments are not restricted to the above examples, but may vary within the scope of the attached claims.

What is claimed is:

1. An electronic control circuit for adjusting a control voltage of a device to be controlled, the device comprising a first node and a second node, the control circuit comprising:

a primary coil, a control bus comprising a first secondary coil, a first control diode, a first capacitor and a means for adjusting the control voltage, the means being parallel-connected with the first capacitor, the means and the first capacitor being further series-connected with the first secondary coil and the first control diode, a control voltage supply circuit comprising a series-connected second secondary coil, a second control diode and a second capacitor, the primary coil being connected between the first node and the second node of the device to be controlled, such that the primary coil receives, from the device to be controlled, a current that at least momentarily reaches a first value of zero.

2. An electronic control circuit for adjusting a control voltage of a device to be controlled, the device comprising a first node and a second node, the control circuit comprising:

a primary coil, wherein the primary coil comprises an inductive element having one turn of winding, a control bus comprising a first secondary coil, a first control diode, a first capacitor and a means for adjusting the control voltage, the means being parallel-connected with the first capacitor, the means and the first capacitor being further series-connected with the first secondary coil and the first control diode, a control voltage supply circuit comprising a series-connected second secondary coil, a second control diode and a second capacitor, the primary coil being connected between the first node and the second node of the device to be controlled, and the first node and the second node being selected such that a current in the primary coil at least momentarily reaches a first value of zero.

3. An electronic control circuit for adjusting a control voltage of a device to be controlled, the device comprising a first node and a second node, the control circuit comprising:

a primary coil, a control bus comprising a first secondary coil, a first control diode, a first capacitor and a means for adjusting the control voltage, the means being parallel-connected with the first capacitor, the means and the first capacitor being further series-connected with the first secondary coil and the first control diode, wherein the means for adjusting the control voltage comprises an adjustable zener diode, a control voltage supply circuit comprising a series-connected second secondary coil, a second control diode and a second capacitor, the primary coil being connected between the first node and the second node of the device to be controlled, and the first node and the second node being selected such that a current in the primary coil at least momentarily reaches a first value of zero.

4. A control circuit as claimed in claim 2, wherein the means for adjusting the control voltage comprises an adjustable zener diode.

5. An electronic control circuit for adjusting a control voltage of a device to be controlled, the device comprising a first node and a second node, the control circuit comprising:

a primary coil, a control bus comprising a first secondary coil, a first control diode, a first capacitor and a means for adjusting the control voltage, the means being parallel-connected with the first capacitor, the means and the first capacitor being further series-connected with the first secondary coil and the first control diode, a control voltage supply circuit comprising a series-connected second secondary coil, a second control diode and a second capacitor, the primary coil being connected between the first node and the second node of the device to be controlled, and the first node and the second node being selected such that a current in the primary coil at least momentarily reaches a first value of zero, wherein the first node and the second node are further selected such that the current in the primary coil at least momentarily reaches a second value of approximately 0.1 A.

6. An electronic control circuit for adjusting a control voltage of a device to be controlled, the device comprising a first node and a second node, the control circuit comprising:

a primary coil, a control bus comprising a first secondary coil, a first control diode, a first capacitor and a means for adjusting the control voltage, the means being parallel-connected with the first capacitor, the means and the first capacitor being further series-connected with the first secondary coil and the first control diode, a control voltage supply circuit comprising a series-connected second secondary coil, a second control diode and a second capacitor, the primary coil being connected between the first node and the second node of the device to be controlled, and the first node and the second node being selected such that a current in the primary coil at least momentarily reaches a first value of zero, the first secondary coil having a first number of windings, the second secondary coil having a second number of windings where the first number of windings is approximately equal to the second number of windings.

7. A control circuit as claimed in claim 1, wherein the device to be controlled comprises a phase angle controller.

8. A control circuit as claimed in claim 1, wherein the device to be controlled comprises a lamp transformer.

9. An electronic control circuit of r adjusting a control voltage of a fluorescent lamp, the lamp being connected to a ballast circuit having a first node and a second node, comprising:

a primary coil, a control bus comprising a first secondary coil, a first control diode, a first capacitor, an adjustable zener diode, the adjustable zener diode being parallel-connected with the first capacitor, the adjustable zener diode and the first capacitor being further series connected with the first secondary coil and the first control diode, a control voltage supply circuit comprising a series-connected second secondary coil, a second control diode and a second capacitor, the primary coil being connected between the first node and the second node of the ballast circuit such that a current in the primary coil at least momentarily reaches a first value of zero.

10. A control circuit as claimed in claim 9, wherein the primary coil comprises an inductive element having one turn of winding.

11. A control circuit as claimed in claim 9, wherein the first node and the second node are further selected such that the current in the primary coil at least momentarily reaches a second value of approximately 0.1 A.

12. A control circuit as claimed in claim 9, the first secondary coil having a first number of windings, the second secondary coil having a second number of windings where the first number of windings is approximately equal to the second number of windings.

13. An electronic control circuit for adjusting a control voltage of a lamp, the lamp being connected to a lamp control circuit having a first node and a second node, comprising:

a primary coil, a control bus comprising a first secondary coil, a first control diode, a first capacitor, an adjustable zener diode, the adjustable zener diode being parallel-connected with the first capacitor, the adjustable zener diode and the first capacitor being further series connected with the first secondary coil and the first control diode, a control voltage supply circuit comprising a series-connected second secondary coil, a second control diode and a second capacitor, the primary coil being connected between the first node and the second node of the lamp control circuit such that a current in the primary coil at least momentarily reaches a first value of zero.

14. A control circuit as claimed in claim 13, wherein the primary coil comprises an inductive element having one turn of winding.

15. A control circuit as claimed in claim 13, wherein the first node and the second node are further selected such that the current in the primary coil at least momentarily reaches a second value of approximately 0.1 A.

16. A control circuit as claimed in claim 13, the first secondary coil having a first number of windings, the second secondary coil having a second number of windings where the first number of windings is approximately equal to the second number of windings.

* * * * *

UNITED STATES PATENT AND TRADEMARK OFFICE

CERTIFICATE OF CORRECTION

PATENT NO. : 6,437,521 B1
DATED : August 20, 2002
INVENTOR(S) : Pienisaari

It is certified that error appears in the above-identified patent and that said Letters Patent is hereby corrected as shown below:

Column 6,
Line 52, "An electronic control circuit of r" should read -- An electronic control circuit for --

Signed and Sealed this

Thirty-first Day of December, 2002

JAMES E. ROGAN
*Director of the United States Patent and Trademark Office*

UNITED STATES PATENT AND TRADEMARK OFFICE

CERTIFICATE OF CORRECTION

PATENT NO. : 6,437,521 B1
DATED : August 20, 2002
INVENTOR(S) : Pienisaari

It is certified that error appears in the above-identified patent and that said Letters Patent is hereby corrected as shown below:

Title page, Item [54] and Column 1, line 1,
Title, should be corrected to read -- ELECTRONIC CONTROL CIRCUIT FOR ADJUSTING A CONTROL VOLTAGE --

Title page,
Item [73], Assignee, "Innoware Oy (FI)" should be corrected to read -- Innoware Oy, Lahti (FI) --
Insert Item:
-- [30] Foreign Application Priority Data
June 11, 1998 (FI) 981351 --

Signed and Sealed this

Thirtieth Day of November, 2004

JON W. DUDAS
*Director of the United States Patent and Trademark Office*